US010392728B2

(12) United States Patent
Clement et al.

(10) Patent No.: US 10,392,728 B2
(45) Date of Patent: Aug. 27, 2019

(54) FABRIC FOR ELECTROMAGNETIC SHIELDING

(71) Applicant: TRESSE INDUSTRIE, Ambert (MX)

(72) Inventors: Gilles Clement, Ambert (FR); Pierre Omerin, Ambert (FR)

(73) Assignee: TRESSE INDUSTRIE, Ambert (FR)

( * ) Notice: Subject to any disclaimer, the term of this patent is extended or adjusted under 35 U.S.C. 154(b) by 24 days.

(21) Appl. No.: 15/319,509

(22) PCT Filed: Jun. 15, 2015

(86) PCT No.: PCT/FR2015/051584
§ 371 (c)(1),
(2) Date: Dec. 16, 2016

(87) PCT Pub. No.: WO2015/193602
PCT Pub. Date: Dec. 23, 2015

(65) Prior Publication Data

US 2017/0321353 A1 Nov. 9, 2017

(30) Foreign Application Priority Data

Jun. 16, 2014 (FR) ..... 14 55480

(51) Int. Cl.
*D03D 1/00* (2006.01)
*D03D 13/00* (2006.01)
*D03D 15/00* (2006.01)

(52) U.S. Cl.
CPC ..... *D03D 1/0058* (2013.01); *D03D 13/00* (2013.01); *D03D 13/008* (2013.01);
(Continued)

(58) Field of Classification Search
CPC .... Y10T 442/30; H01B 11/16; D03D 13/008; D03D 15/0094; D03D 1/0058;
(Continued)

(56) References Cited

U.S. PATENT DOCUMENTS 4,668,545 A * 5/1987 Lowe ..... B29C 61/0658 139/387 R
6,381,482 B1 * 4/2002 Jayaraman ..... A61B 5/6805 600/388
(Continued)

FOREIGN PATENT DOCUMENTS

EP 1731643 A1 12/2006
EP 2233620 A2 9/2010
(Continued)

OTHER PUBLICATIONS

Jung-Sim Roh, Yong-Seung Chi, Tae Jin Kang, Sang-wook Nam; "Electromagnetic Shielding Effectiveness of Multifunctional Metal Composites"; Textile Research Journal, vol. 78(9): 825-835; online http://trj.safepub.com copyright 2008 (Year: 2008).*
(Continued)

*Primary Examiner* — Jennifer A Steele
(74) *Attorney, Agent, or Firm* — Cantor Colburn LLP

(57) ABSTRACT

The invention relates to a fabric for electromagnetic shielding having a weave of interlaced weft threads (2) and warp threads (3). In addition, the warp threads (3) are conductive and include multi-filament or mono-filament textile conductors associated with metal strands and at least one conductive warp thread (4) is inserted into a weft such as to create equipotential bonding perpendicular to the direction of the warp threads (3).

20 Claims, 6 Drawing Sheets

(52) U.S. Cl.
CPC ..... *D03D 15/0094* (2013.01); *D10B 2101/20* (2013.01); *D10B 2321/042* (2013.01); *D10B 2331/02* (2013.01); *D10B 2331/021* (2013.01); *D10B 2331/04* (2013.01); *D10B 2401/041* (2013.01); *D10B 2401/16* (2013.01)

(58) Field of Classification Search
CPC ..... D10B 2101/20; D10B 2321/042; D10B 2331/021; D10B 2331/04; D10B 2401/041; D10B 2401/16; H05K 9/00
See application file for complete search history.

(56) References Cited

U.S. PATENT DOCUMENTS

| | | | | |
|---|---|---|---|---|
| 6,569,789 | B1 * | 5/2003 | Shioda | H05K 9/0015 428/304.4 |
| 2009/0272455 | A1 * | 11/2009 | Speich | D03D 1/0088 139/22 |

FOREIGN PATENT DOCUMENTS

| | | | |
|---|---|---|---|
| EP | 2524983 | A2 | 11/2012 |
| FR | 2920442 | A1 | 3/2009 |

OTHER PUBLICATIONS

Weft Insertion definition, Textile Glossary, Celanese Acetate, copyright 2001 (Year: 2001).*
English Translation to Abstract for FR2920442.
International Search Report for International Application No. PCT/FR2015/051584.

* cited by examiner

FABRIC FOR ELECTROMAGNETIC SHIELDING

TECHNICAL FIELD

The present invention concerns a fabric for electromagnetic shielding.

BACKGROUND

It is possible to notice, in particular in the general field of transportation, that numerous functions are carried out by electric driving units.

Consequently, cables connecting batteries to electric actuators are found in numerous apparatuses such as—non-restrictively—: aircrafts, motor vehicles in particular electric and/or hybrid vehicles, etc.

The presence of harnesses of conductive cables has an impact at two levels.

On the one hand, these cables, being crossed by an electric current, emit an electromagnetic field which is disturbing for their environment. It is also appropriate that these cables are not disturbed by possible electromagnetic fields. In other words, it is appropriate to prevent any signal to escape from the cable and also to prevent any parasitic signal to be added to the signal conveyed by this same cable.

On the other hand, the conductive cables are integrated in an apparatus—aircraft, motor vehicle or the like—and, consequently, may be brought into contact with mechanical members of the concerned apparatus. During operation, vibrations that show friction cycles between the cables and the surrounding members, may be produced; these vibrations may damage the cables.

Hence, the electric cables are protected by sheaths which ensure an electromagnetic shielding and a mechanical protection.

In terms of electromagnetic shielding sheath, there is known, for example, from the document EP 1 348 247, an electromagnetic shielding braid which ensures both an electromagnetic shielding—in the range of 50/60 dB at 30/40 MHz—and quality mechanical protection.

However, the principle of the braid, which is therefore closed on itself, may prohibit some applications thereto. Indeed, the set-up of a shielding braid is performed by introducing an end of the cable in the sheath and then making it slide on the cable.

Thus, the set-up of a sheath on a cable which is installed cannot be done without dismounting the latter.

There are also sheaths called self-closing shielding sheaths. Unlike the braided sheaths, these sheaths are constituted by woven ribbons. The warp threads comprise conductive metal strands in order to ensure the shielding function, whereas the weft threads comprise thermo-formable monofilament strands in order to ensure the self-maintaining function of the tubular-shaped sheath.

Given their open construction, the self-closing woven shielding sheaths present poor performances. Their generally observed effectiveness is in the range of 30 dB at 30/40 MHz, namely an electromagnetic effectiveness deteriorated by about 20 to 30 dB in comparison with a braided sheath, such as described before.

The reason why the conventional self-closing woven sheaths present a low shielding capability mainly lies in the absence of equipotential bonding. In order to overcome this absence, tricks are used to create equipotential bondings.

Thus, it is known to place metal collars, for example, at the ends of the sheath. It is also known to perform ties by metal collars at even intervals. This presents a cost both in equipment and in installation time.

Besides, these self-closing woven sheaths may be relatively heavy, which constitutes a handicap for this type of sheaths in particular for aeronautical applications.

In this technical context, an aim of the invention is to provide a light self-closing fabric presenting an electromagnetic shielding effectiveness close to the values of a braided tubular metal sheath, 50-60 dB at 30/40 MHz.

BRIEF SUMMARY

Thus, the invention concerns a fabric for electromagnetic shielding presenting a weave of interwoven weft threads and warp threads, wherein the warp threads are conductive and comprise monofilament or multifilament threads having metal strands and in that, at least one conductive warp thread is inserted within the weft thread to create an equipotential connection perpendicular to the direction of the warp threads. Preferably, the fabric comprises several conductive warp threads warp-inserted according to a pitch comprised between 1 and 8 in the sheds.

According to a preferred embodiment of the invention, the fabric comprises conductive warp threads forming an electromagnetic protection face, warp threads forming a mechanical protection face and warp threads ensuring bonding of the conductive warp threads forming the electromagnetic protection face and of the warp threads forming the mechanical protection face.

In addition, the conductive warp threads forming the electromagnetic protection face are woven according to a plain weave and the warp threads forming a mechanical protection face are woven according to a plain weave.

According to other features of the fabric according to the invention:

- the ratio of the diameters of the monofilaments and of the metal strands in the warp threads is at least 2.5.
- the diameter of the monofilaments is in the range of 0.125 mm to 0.40 mm and the diameter of the metal strands is in the range of 0.05 mm to 0.16 mm.
- the weft threads are constituted by one or several material(s) of the group comprising: PET; PET-FR; PBT; PMMA; PA4.6; PA6.6; PA11; PA12; PPS; PEEK; ECTFE; PVDF; ETFE FEP; PFA; PTFE.
- the warp threads associated to the metal strands are constituted by one or several material(s) of the group comprising: PET; PBT; PMMA; polyethylene; Polyamides; acrylics; carbons; PAN; polypropylene; PPS; polyimides; PEEK; ECTFE; PVDF; Fluorofibers; glass fibers; ceramic and mineral fibers, aramid and meta-aramid fibers; bare or tin-coated copper, nickel, silver, bare or tin-plated brass; Aluminum, aluminum alloys, bare steel, zinc-plated steel, tin-plated copper-plated steel, nickel-plated copper-plated steel, silver-plated copper-plated steel, inox, inconel®, Monel®, nickel and nickel alloys, Copper-Nickel alloys.
- the fabric receives a coating layer of one or several element(s) of the group comprising Copper, Zinc, Nickel or Silver.

According to another aspect, the invention concerns a sheath formed by the aforementioned fabric.

In one embodiment, the sheath comprises a conductive strip of conductive warp threads inserted by weaving in the plain weave on the mechanical protection face so that the conductive strip is covered by the opposite face on the electromagnetic protection face side of the sheath and constitutes a closure of the electrical circuit of the electromagnetic protection face when the sheath is closed on itself.

BRIEF DESCRIPTION OF THE DRAWINGS

For a better understanding thereof, the invention is described with reference to the drawing appended herein and representing, as a non-limiting example, several embodiments of a fabric according to the invention.

DETAILED DESCRIPTION

Figure 2:
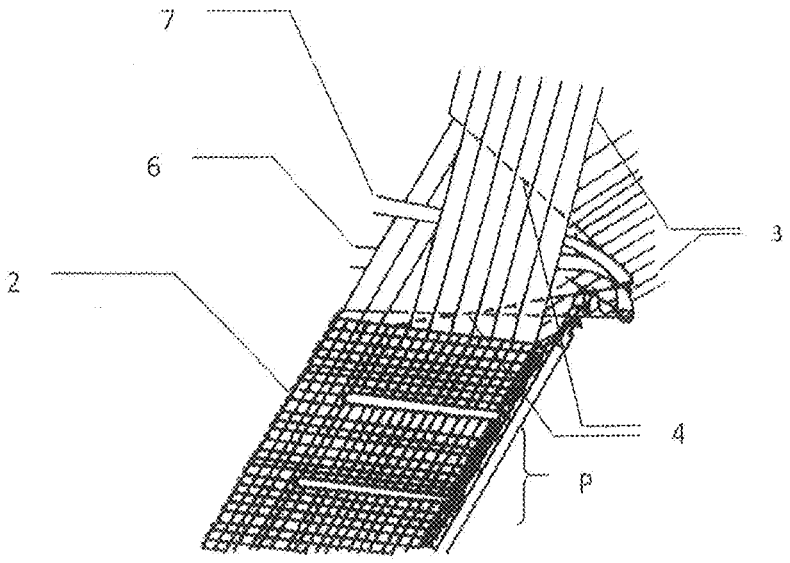
FIG. 2 is a schematic view of the fabric during weaving.

As can be seen in FIG. 2, the fabric 1 for electromagnetic shielding presents a weave of interwoven weft threads 2 and warp threads 3.

The warp threads 3 comprise conductive strands associated to textile fibers. Practically, the conductive warp threads 3 may comprise threads of monofilaments associated to metal strands. The metal strands may be incorporated to the threads of monofilaments by wrapping, stranding or braiding.

In practice, the ratio of the diameters of the monofilaments and of the metal strands in the warp threads may be at least 2.5 mm.

Thus, it is possible to consider an embodiment of the invention in which the diameter of the monofilaments is in the range of 0.25 mm and the diameter of the metal strands is in the range of 0.15 mm.

The weft threads 2 may be conductive threads but, preferably, they are non-conductive threads mainly composed of thermoplastic monofilaments, for example PET; PET-FR; PBT; PMMA; PA4.6; PA6.6; PA11; PA12; PPS; PEEK; ECTFE; PVDF; ETFE FEP; PFA; PTFE so that the fabric incorporating these weft threads 2 presents a contained linear density.

FIG. 2 shows the manner in which the first step of manufacturing the fabric according to the invention is carried out.

Figure 1:
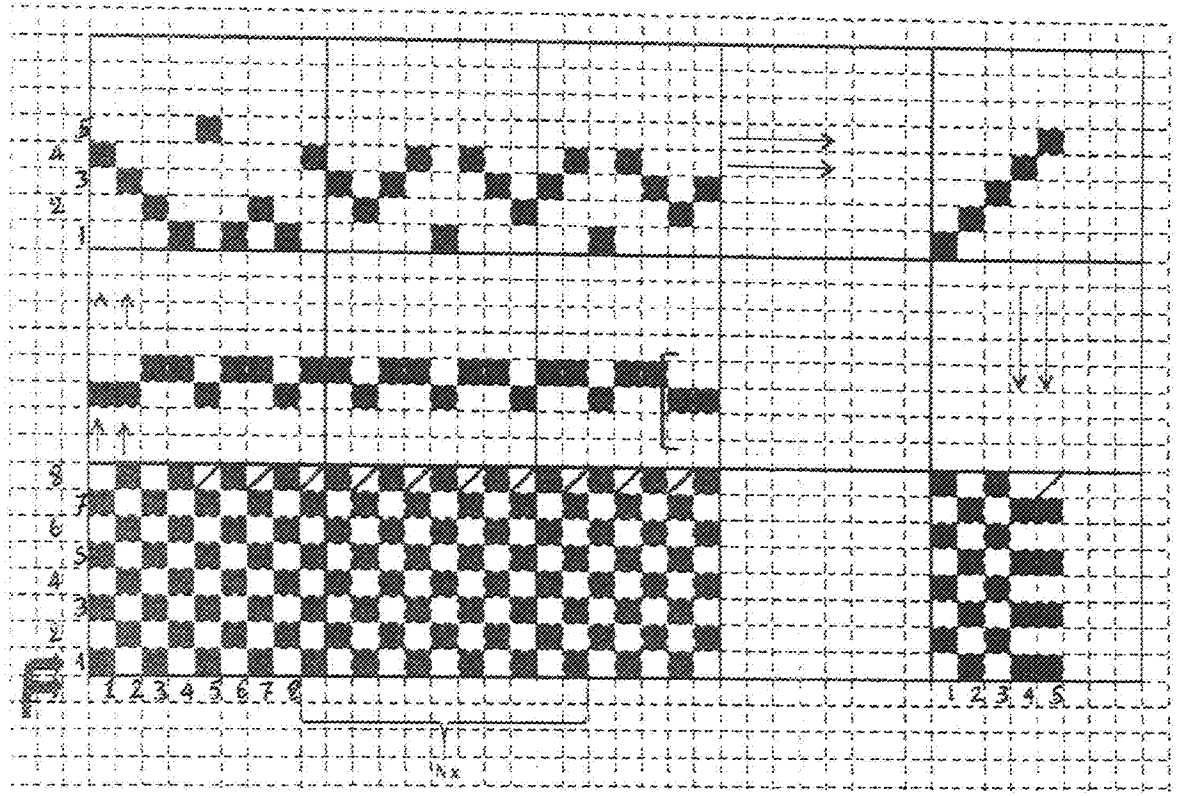
FIG. 1 is a schematic view of the weave of a fabric according to one embodiment of the invention.

As shown in this figure, a warp thread 4—which is therefore conductive—is intended to be inserted in the weft at a predetermined pitch P which may be, for example, of 8 picks, according to the example of FIG. 1.

In FIG. 1, the reference numerals refer to:

1 textile thread
2 textile thread
3 metal thread
4 textile thread
5 weft-inserted metal thread
6 textile thread
7 textile thread
8 metal thread.

It is also possible to interpose other conductive threads of the warp in the weft by arranging them on different frames and by selecting them over sequences with a minimum pick but phase-shifted with respect to each other.

For this purpose, the loom is fitted with a weft-insertion lower needle 6 and with a weft-insertion upper needle 7; these needles will therefore allow inserting, in the weft composed of non-conductive threads, a warp thread which is conductive.

According to another possibility, it is possible to use a needle which presents a profile allowing it to take, depending on the thread presented thereto, the weft thread and the warp thread which is conductive.

Thus, the fabric according to the invention is provided with a conductive thread in the weft direction which therefore forms an equipotential bonding. The fabric obtained accordingly presents an interlacing of conductive threads, which turns out to be very advantageous to the electromagnetic effectiveness.

After weaving, the fabric undergoes a phase of treatment, mainly by heating, which is known per se for giving it its shape-memory property, that is to say its ability to wrap on itself.

Figure 3:
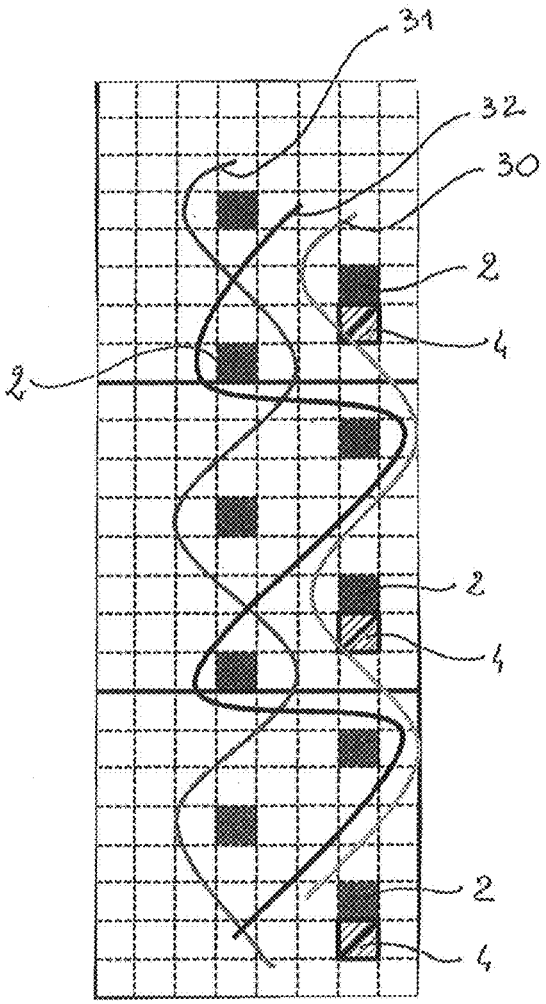
FIGS. 3 and 4 show a double-woven fabric integrating the wefted warp thread respectively in a schematic view and in a weave pattern.
Figure 4:
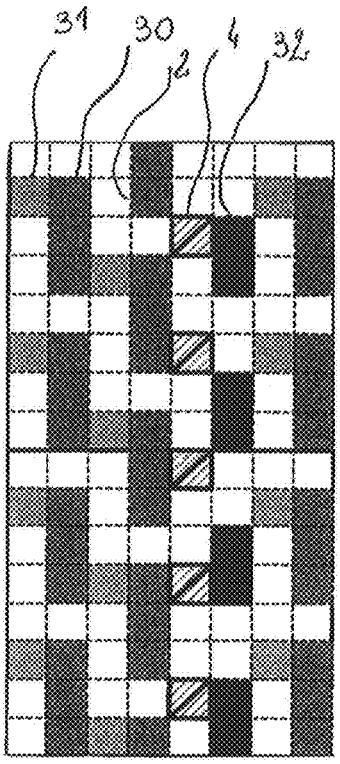
Figure 5:
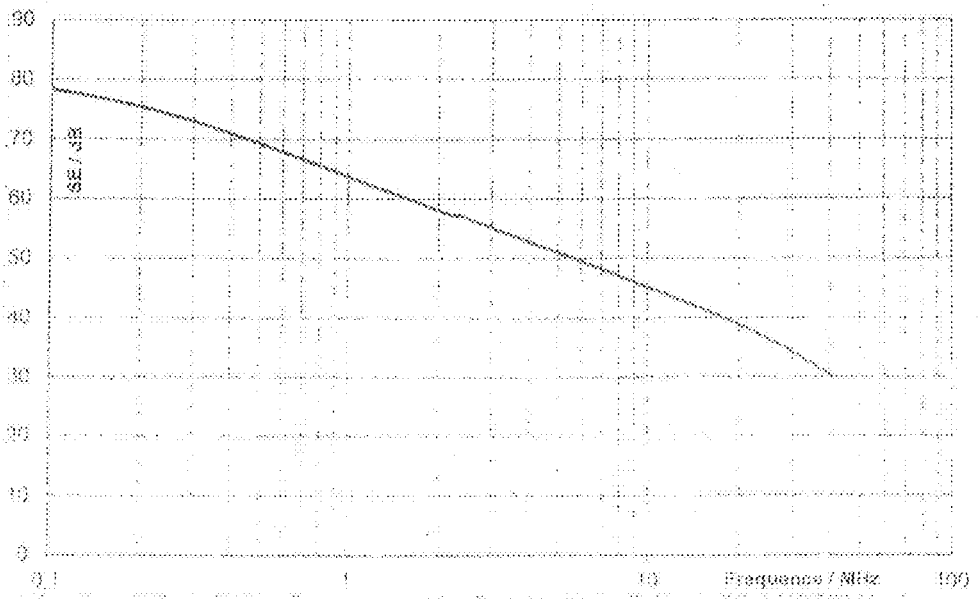
FIGS. 5 to 8 show four measurements of shielding on a three-axial bench according to the arrangements of the standard IEC 62153-4-3, respectively, for a sheath of the prior art and for three sheaths using three embodiments of the fabric according to the invention.

FIG. 3 shows another embodiment of the invention in which the fabric presents two faces which appear visually different from each other so as to distinguish the mechanical protection and electromagnetic protection functions.

In this embodiment of the invention, the fabric is woven according to the double-weaving method with a particular bonding thread.

FIG. 3 schematically shows the weave of the fabric with the double-weaving. This particular method is combined with the conductive warp thread 30 weft-inserted in the weaving of an electromagnetic protection face.

FIG. 3 shows a loose bond which is used in this example; the conductive threads of the warp are grouped together in a plain-type weave so as to constitute the electromagnetic protection face, the monofilament or multifilament threads of the warp 31 are grouped together in a plain-type weave so as to constitute the mechanical protection face. The two weaves are bonded by warp threads 32, chosen monofilaments or multifilaments to constitute the bond.

Preferably, the bonding threads 32 are visible on the mechanical protection side and invisible on the electromagnetic protection side.

In order to prove the effectiveness of the invention, four measurements have been carried out on a three-axial bench according to the terms of the standard IEC 62153-4-3 for a sheath of the prior art and for three sheaths according to the invention.

FIG. 3 shows a measurement of electromagnetic shielding for a sheath composed, according to the prior art, of a fabric having (i) warp threads made of tin-plated copper with 8 strands of 0.10 mm and monofilaments PET of 0.25 mm and (ii) weft thermoplastic monofilaments PET of a 0.254 mm diameter.

Figure 6:
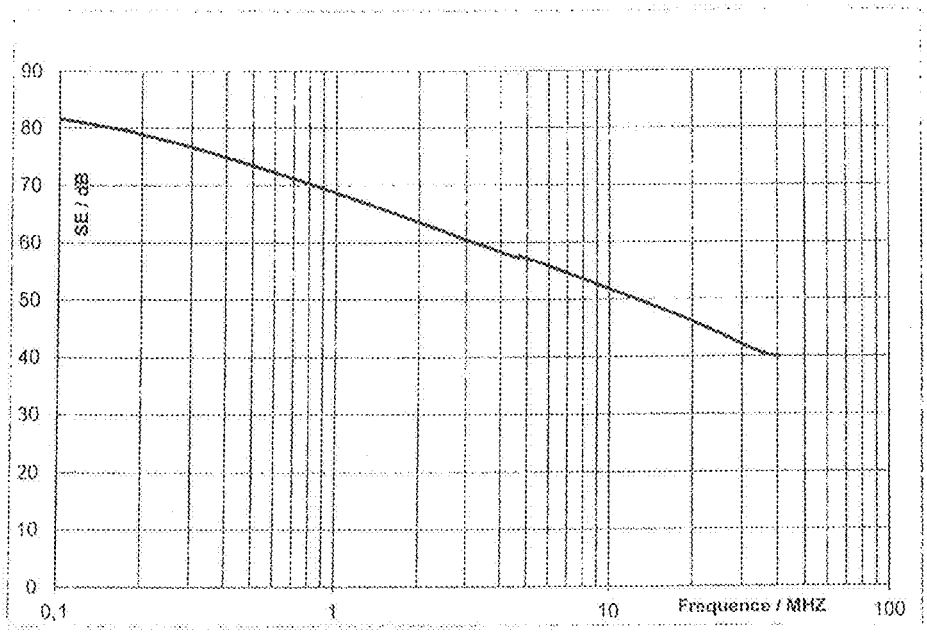

An effectiveness in the range of 34 dB at 30 MHz and 30 dB at 40 MHz is observed FIG. 6 shows a measurement of electromagnetic shielding performed with the fabric represented in FIG. 1. This fabric comprises (i) warp textile threads made of PET and threads made of tin-plated copper with 8 strands of 0.10 mm and (ii) weft thermoplastic monofilaments PET and metal warp threads according to an eight-pick pitch. The measurements performed within the aforementioned standard show an attenuation in the range of 42 dB at 30 MHz and 40 dB for a frequency of 40 MHz.

Figure 7:
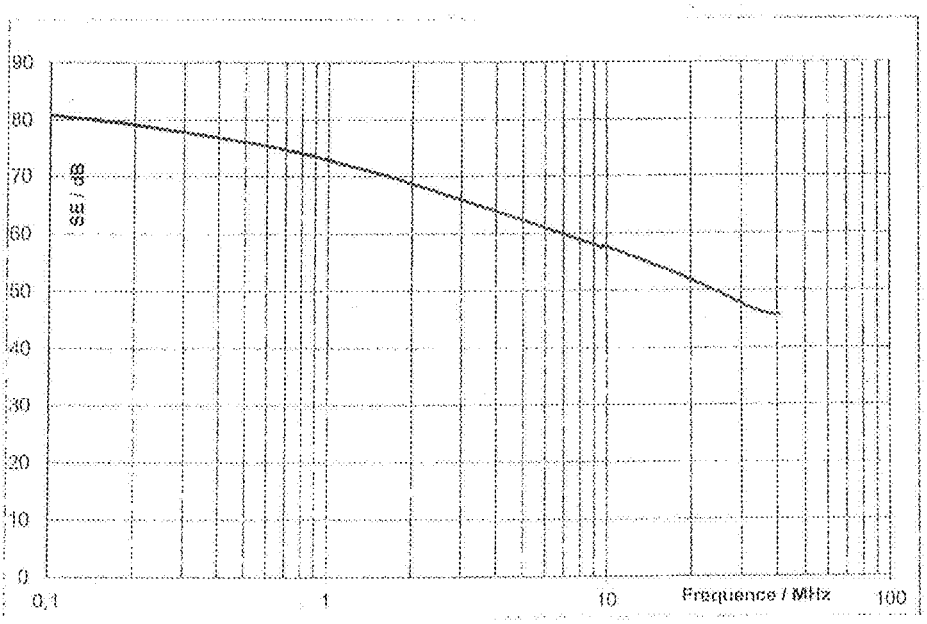

FIG. 7 shows a measurement of electromagnetic shielding performed with a variant of the fabric represented in FIG. 1. This fabric comprises (i) warp textile threads made of PET and threads made of tin-plated copper with 8 strands of 0.10 mm and (ii) weft thermoplastic monofilaments made PET and metal warp threads inserted on each pick. The measurements performed within the aforementioned standard show an attenuation in the range of 48 dB at 30 MHz and 45 dB for a frequency of 40 MHz.

Optionally, in order to enhance the effectiveness of shielding, it is possible to consider performing a deposition of a metal coating on the fabric. This coating may be performed by an electrochemical deposition according to known techniques. A thickness comprised in an interval from 0.2 μm to 1.3 μm is deposited depending on the desired level of shielding attenuation.

Figure 8:
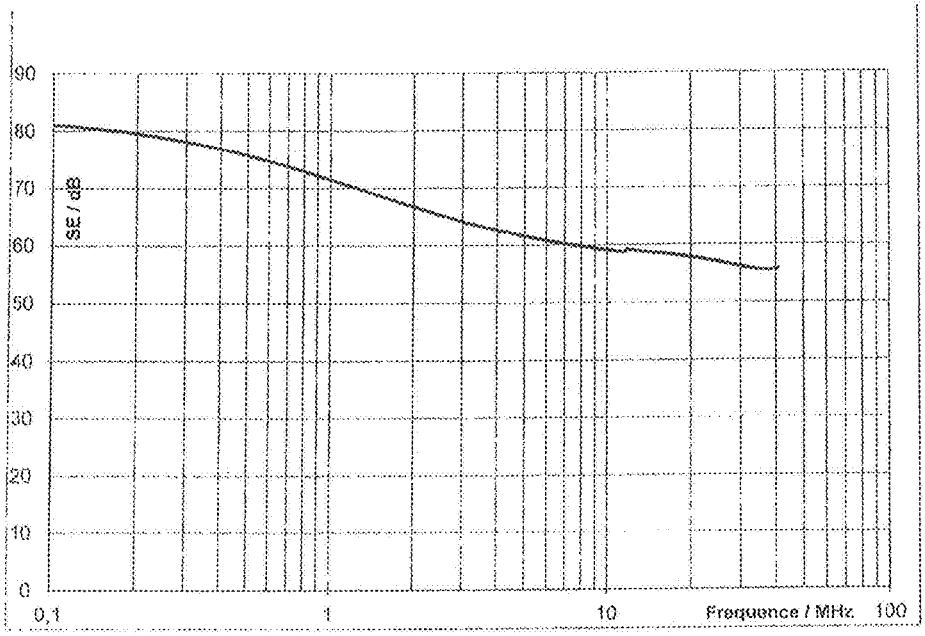

FIG. 8 shows a measurement of electromagnetic shielding performed with a variant of the fabric represented in FIG. 1, the latter having received a Nickel coating. This fabric comprises (i) warp textile threads made of PET and threads made of tin-plated copper with 8 strands of 0.10 mm, (ii) weft thermoplastic monofilaments made PET and metal warp threads inserted according to an eight-pick pitch and (iii) a metallized coating electrochemically deposited over a thickness in the range of 0.7 μm, knowing that the coating may have a thickness comprised between 0.2 μm and 1.3 μm. The measurements performed within the aforementioned standard show an attenuation in the range of 56 dB at 30 MHz and 55.5 dB for a frequency of 40 MHz.

These measurements prove that the sheaths performed with the fabric according to the invention in several variants present an electromagnetic shielding which is significantly higher than the sheaths of the prior art.

In order to improve the performance of electromagnetic shielding of the tubular sheath, the sheath which is formed by a fabric strip closed on itself comprises a conductive strip of conductive warp threads inserted by weaving in the plain weave on the mechanical protection face so that the conductive strip is covered by the opposite face on the electromagnetic protection face side of the sheath and constitutes a closure of the electrical circuit of the electromagnetic protection face when the sheath is closed on itself.

Of course, the invention is not limited to the variants described for a plain weave (Taffeta), as example, but it encompasses all embodiments such as Twill, Satin, Reps, crosswise Reps (ribbed), Lengthwise Reps, basket weave (Panama), etc.

The invention claimed is:

1. A fabric for electromagnetic shielding presenting a weave of interwoven weft threads and warp threads, wherein the weft threads are non-conductive and wherein the warp threads are conductive and comprise multifilament or monofilament textile conductive threads having metal strands and in that, at least one conductive warp thread is weft inserted within the non-conductive weft threads to create an equipotential connection perpendicular to the direction of the warp threads.

2. The fabric for electromagnetic shielding according to claim 1, wherein the at least one conductive warp thread is several conductive warp threads weft inserted according to a pitch P comprised between 1 and 8 in the sheds.

3. The fabric for electromagnetic shielding according claim 1, wherein the fabric comprises conductive warp threads forming an electromagnetic protection face, warp threads forming a mechanical protection face and warp threads ensuring the bonding of the conductive warp threads forming the electromagnetic protection face and the warp threads forming the mechanical protection face.

4. The fabric according to claim 3, wherein the conductive warp threads forming the electromagnetic protection face are woven according to a plain weave and the warp threads forming a mechanical protection face are woven according to a plain weave.

5. The fabric for electromagnetic shielding according to claim 1, wherein the ratio of the diameters of the monofilaments and of the metal strands in the conductive warp threads is of at least 2.5.

6. The fabric for electromagnetic shielding according to claim 5, wherein the diameter of the monofilaments is in the range of 0.125 mm to 0.40 mm and the diameter of the metal strands is in the range of 0.05 mm to 0.16 mm.

7. The fabric for electromagnetic shielding according to claim 1, wherein the at least one conductive warp thread inserted within the weft thread is constituted by one or several material(s) of the group comprising: PET; PET-FR; PBT; PMMA; PA4.6; PA6.6; PA11; PA12; PPS; PEEK; ECTFE; PVDF; ETFE FEP; PFA; PTFE.

8. The fabric for electromagnetic shielding according to claim 1, wherein the fabric receives a metal layer having a thickness comprised between 0.2 μm and 1.3 μm.

9. The fabric for electromagnetic shielding according to claim 8, wherein the metal layer comprises one or several metal(s) of the group comprising nickel and zinc and copper and silver.

10. The fabric for electromagnetic shielding according to claim 1, wherein the warp threads are constituted by strands of one or several material(s) of the group comprising: PET; PBT; PMMA; polyethylene; Polyamides; acrylics; carbons; PAN; polypropylene; PPS; polyimides; PEEK; ECTFE; PVDF; Fluorofibers; glass fibers; ceramic and mineral fibers, aramid and meta-aramid fibers; bare or tin-coated Copper, nickel, silver, bare or tin-plated brass; Aluminum, aluminum alloys, bare steel, zinc-plated steel, tin-plated copper-plated steel, nickel-plated copper-plated steel, silver-plated copper-plated steel, inox, inconel®, Monel ®, nickel, nickel alloys, Copper-Nickel alloys.

11. An electromagnetic shielding sheath comprising a fabric strip according to claim 1.

12. The sheath according to claim 11, wherein the fabric further comprises conductive warp threads forming an electromagnetic protection face, warp threads forming a mechanical protection face and warp threads ensuring the bonding of the conductive warp threads forming the electromagnetic protection face and the warp threads forming the mechanical protection face and wherein the sheath comprises a conductive strip of conductive warp threads inserted by weaving in the plain weave on the mechanical protection face so that the conductive strip is covered by the opposite face on the electromagnetic protection face side of the sheath and constitutes a closure of the electrical circuit of the electromagnetic protection face when the sheath is closed on itself.

13. The fabric for electromagnetic shielding according to claim 3, wherein the at least one conductive wrap thread is several conductive warp threads warp-inserted according to a pitch P comprised between 1 and 8 in the sheds.

14. The fabric according to claim 13, wherein the conductive warp threads forming the electromagnetic protection face are woven according to a plain weave and the warp threads forming the mechanical protection face are woven according to a plain weave.

15. The fabric for electromagnetic shielding according to claim 14, wherein the ratio of the diameters of the monofilaments and of the metal strands in the conductive warp threads is of at least 2.5.

16. The fabric for electromagnetic shielding according to claim 15, wherein the diameter of the monofilaments is in the range of 0.125 mm to 0.40 mm and the diameter of the metal strands is in the range of 0.05 mm to 0.16 mm.

17. The fabric for electromagnetic shielding according to 15, wherein the thermoplastic monofilaments included in the weft threads are constituted by one or several material(s) of the group comprising: PET; PET-FR; PBT; PMMA; PA4.6; PA6.6; PA11; PA12; PPS; PEEK; ECTFE; PVDF; ETFE FEP; PFA; PTFE.

18. The fabric for electromagnetic shielding according to claim 17, wherein the fabric receives a metal layer having a thickness comprised between 0.2 μm and 1.3 μm.

19. The fabric for electromagnetic shielding according to claim 18, wherein the warp threads are constituted by strands of one or several material(s) of the group comprising: PET; PBT; PMMA; polyethylene; Polyamides; acrylics; carbons; PAN; polypropylene; PPS; polyimides; PEEK; ECTFE; PVDF; Fluorofibers; glass fibers; ceramic and mineral fibers, aramid and meta-aramid fibers; bare or tin-coated Copper, nickel, silver, bare or tin-plated brass; Aluminum, aluminum alloys, bare steel, zinc-plated steel, tin-plated copper-plated steel, nickel-plated copper-plated steel, silver-plated copper-plated steel, inox, inconel®, Monel®, nickel, nickel alloys, Copper-Nickel alloys.

20. An electromagnetic shielding sheath comprising a fabric strip according to claim 19, wherein the sheath comprises a conductive strip of conductive warp threads inserted by weaving in the plain weave on the mechanical protection face so that the conductive strip is covered by the opposite face on the electromagnetic protection face side of the sheath and constitutes a closure of the electrical circuit of the electromagnetic protection face when the sheath is closed on itself.

* * * * *